United States Patent [19]

Sakata et al.

[11] Patent Number: 4,592,449

[45] Date of Patent: Jun. 3, 1986

[54] HYDRAULIC POWER PIPING UNIT FOR A LIFT TRUCK

[75] Inventors: Masataka Sakata, Handa; Masakazu Asano, Ohbu, both of Japan

[73] Assignee: Kabushiki Kaisha Toyoda Jidoshokki Seisakusho, Aichi, Japan

[21] Appl. No.: 703,909

[22] Filed: Feb. 21, 1985

[30] Foreign Application Priority Data

Feb. 23, 1984 [JP] Japan ..... 59-026372[U]

[51] Int. Cl.[4] ..... B66B 9/20

[52] U.S. Cl. ..... 187/9 E; 137/355.17; 414/631

[58] Field of Search ..... 187/9 R, 9 E, 1 R; 414/785, 628, 629, 630, 631, 618; 137/355.17, 355.16, 355.24

[56] References Cited

U.S. PATENT DOCUMENTS 3,968,859 7/1976 Ehrhardt ..... 187/9 E 4,503,936 3/1985 Rice ..... 187/9 R

*Primary Examiner*—Joseph J. Rolla

*Assistant Examiner*—Kenneth Noland

*Attorney, Agent, or Firm*—Burgess, Ryan & Wayne

[57] ABSTRACT

A lift truck having a hydraulic power piping unit mounted and encased in a full free lift upright assembly arranged in front of the truck body. The piping unit has a pair of laterally spaced stationary and movable hose guides, the former being fixed to stationary outer masts and the latter attached to movable inner masts or a free lift cylinder held by the inner masts. The hose guides receive therein flexible hydraulic hoses, and hold rigid hydraulic pipes which connect the flexible hydraulic hoses to a control valve unit via other flexible hydraulic hoses and to an actuator for a lift truck attachment via further flexible hydraulic hoses.

7 Claims, 4 Drawing Figures

HYDRAULIC POWER PIPING UNIT FOR A LIFT TRUCK

BACKGROUND OF THE INVENTION

1. Field of the Invention

The present invention relates to a hydraulic-power piping unit accommodated in a load-handling lift truck having a truck body and a full free lift upright assembly so as to provide a hydraulic connection between a control valve unit mounted on the truck body and a hydraulic actuator for an attachment mounted on a lift bracket member of the full free lift upright assembly.

2. Description of the Related Art

In a load handling lift truck, specifically, a lift truck having a full free lift upright assembly, it is known to use a hydraulic-power piping unit for providing a hydraulic connection between a control valve unit mounted in a truck body and a hydraulic actuator for a load handling attachment mounted on a free lift bracket which is constructed to be vertically moved by a free lift cylinder disposed in the full free lift upright assembly. The known hydraulic power piping unit has a hose reel on which hydraulic flexible hoses for supply and return of hydraulic power are supported so as to be able to move together with the free lift bracket. The hose reel is attached to an outer part of the full free lift upright assembly. For example, U.S. Pat. No. 3,552,425 to Harlan D. Olson discloses a hose reel of a hydraulic power line takeup unit located outwardly from a mast assembly arranged at the front of a lift truck. The outside location of the hydraulic power piping unit, however, contains a certain disadvantages in that when the free lift upright assembly is in an at-rest or non-lift position, the hose reel is close to an overhead guard of the lift truck body resulting in an extremely restricted backward tilt motion of the free lift upright assembly. The outside location of the hydraulic power piping unit also has other disadvantages in that the hose reel, a rotary joint device, and the pipes and hoses of the hydraulic power piping unit are apt to be damaged due to the probability of their coming into contact with objects in the vicinity of the lift truck, and that this position of the unit entails a considerable loss of hydraulic head.

SUMMARY OF THE INVENTION

An object of the present invention is to eliminate the disadvantages engendered by the location of a known hydraulic power piping unit on a lift truck having a full free lift upright assembly.

Another object of the present invention is to provide a novel construction of a hydraulic power piping unit arranged in such a manner that the unit is located inward of and enclosed by the existing full free lift upright assembly.

In accordance with the present invention, there is provided a hydraulic power piping unit accommodated in a lift truck having a truck body and a full free lift upright assembly which includes a pair of laterally spaced outer stationary masts, a pair of laterally spaced inner masts movable vertically relative to the outer stationary masts, and a free lift cylinder attached to the inner masts for providing a free lift movement for a bracket member relative to the inner masts. The hydraulic power piping unit is assembled in the full free lift upright assembly to enable connection to be made between a hydraulic control valve unit mounted in the truck body and a hydraulic actuator for an attachment to be mounted on the bracket member. The hydraulic power piping unit is characterized by comprising a pair of laterally spaced first and second vertical hose guides for respectively receiving therein the first and second sections of a first assembly of flexible hoses arranged in such a manner that the first flexible hydraulic hose assembly hangs down in a loose U-shape between the first and second guides. The first vertical hose guide is fixedly attached to the outer stationary masts and the second vertical hose guide is attached to one of the inner movable masts and the free lift cylinder for being moved together therewith. A first assembly of rigid hydraulic pipes is held by the first vertical hose guide and stationarily extended so as to connect the first section of the first assembly of flexible hydraulic hoses to a second assembly of flexible hydraulic hoses extending from the hydraulic control valve unit. A second assembly of rigid hydraulic pipes is held by the second movable vertical hose guide and extended so as to connect the second section of the first assembly of flexible hydraulic hoses to a third assembly of flexible hydraulic hoses extending from the hydraulic actuator. Pulley means are rotatably mounted on a vertical piston rod of the free lift cylinder, for supporting thereon a third assembly of flexible hydraulic hoses so as to permit the third assembly of flexible hydraulic hoses to follow the free lift movement of the bracket member.

Other objects, advantages and features of the invention will be made apparent from the ensuing description taken in conjunction with the attached drawings.

DESCRIPTION OF THE PREFERRED EMBODIMENTS

Figure 1:
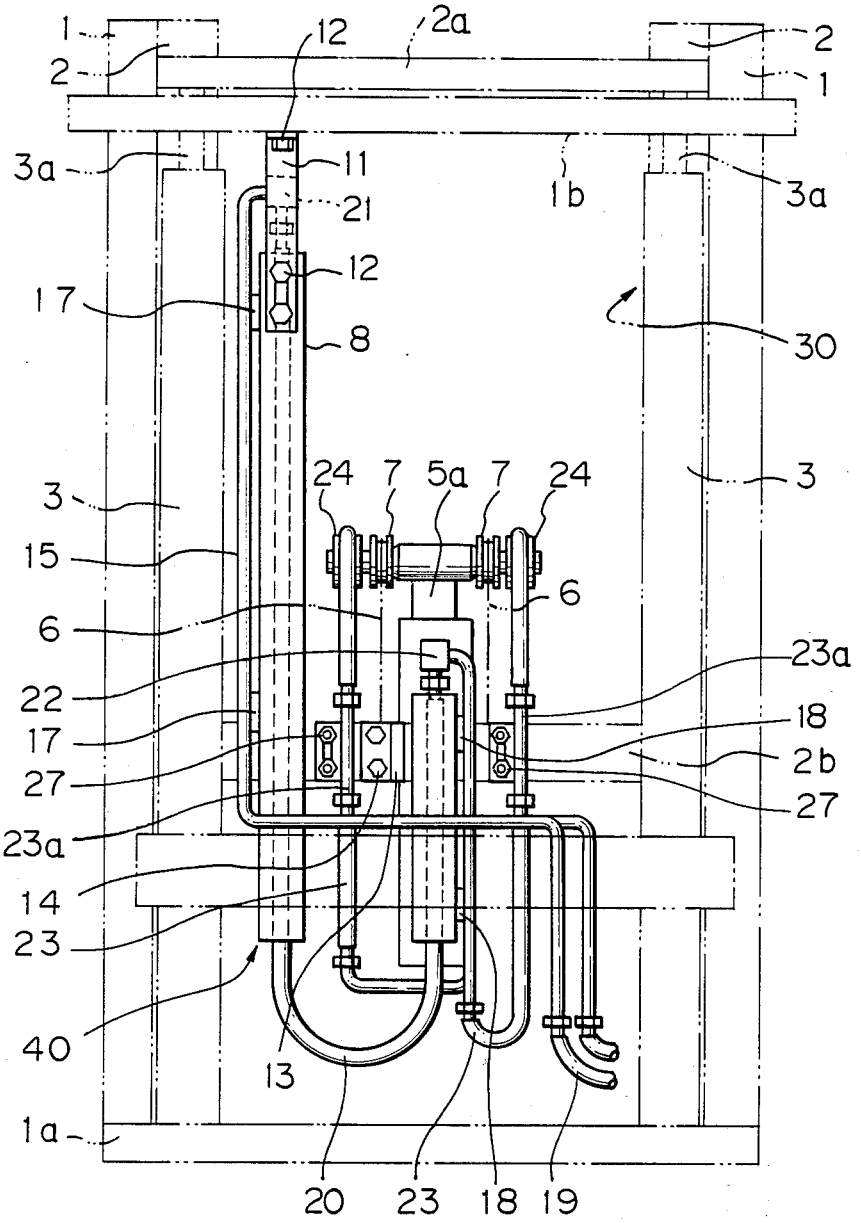
FIG. 1 is a front elevational view of a hydraulic power piping unit, according to an embodiment of the present invention, encased in a full free lift upright assembly of a lift truck.
Figure 2:
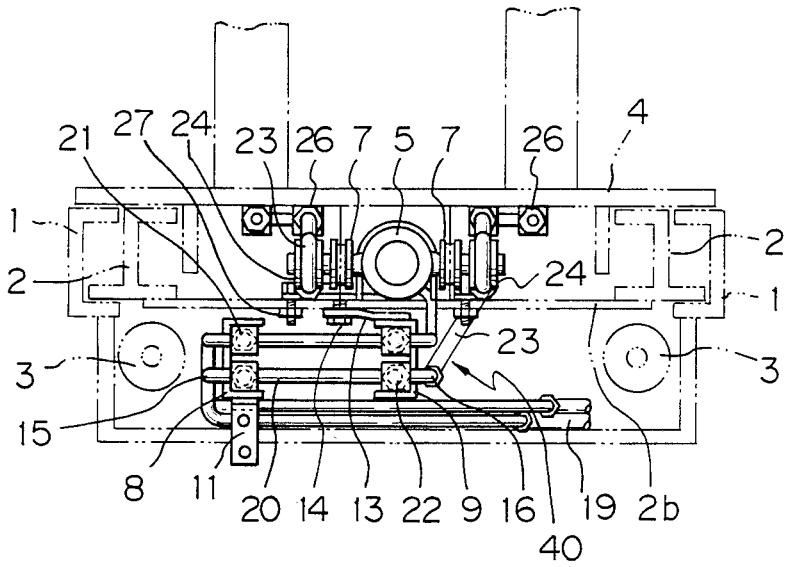
FIG. 2 is a plan view of the hydraulic power piping unit of FIG. 1.
Figure 3:
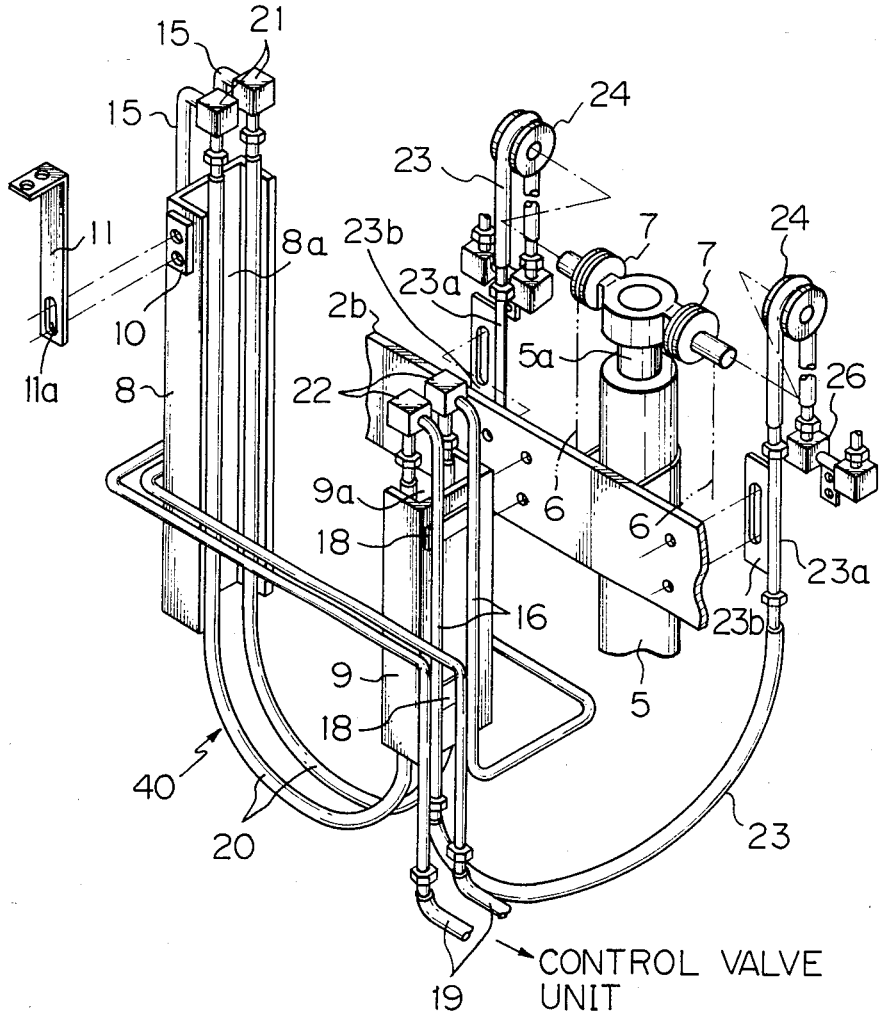
FIG. 3 is an exploded perspective view of the hydraulic power piping unit of FIG. 1.

Referring to FIGS. 1 through 3, a full free lift upright assembly 30 includes a pair of laterally spaced stationary outer masts 1 and a pair of laterally spaced inner masts 2 arranged so as to be moved relative to the outer masts 2 by a pair of lift cylinders 3 positioned on the back of the inner masts 2. The pair of lift cylinders 3 are supported by a lower cross beam 1*a*, and piston rods 3*a* of the two lift cylinders 3 are connected respectively to an upper tie beam 2*a* of the pair of inner masts 2. The full free lift upright assembly 30 also includes a lift bracket member 4 having freedom of movement which is moved vertically by a free lift cylinder 5 positioned centrally between the laterally spaced inner masts 2, and a pair of chains 6. The chains 6 are supported by a pair of chain wheels 7 pivotally mounted on both sides of an upper end of a piston rod 5*a* of the free lift cylinder 5. One end of the respective lift chains 6 is fixedly attached to a middle tie beam 2*b* of the inner masts 2, and the other end of respective lift chains 6 is fixedly attached to the lift bracket member 4. The free lift cylinder 5 is supported by the middle tie beam 2*b*. Thus, when the free lift cylinder 5 is operated so as to extend the piston rod 5*a*, the lift bracket member 4 on which a load handling attachment (not illustrated in FIGS. 1 through 3) is mounted is moved vertically against the inner masts 2.

A hydraulic power piping unit 40 is assembled in the above-described full free lift upright assembly 30 so that supply of hydraulic power to a hydraulic actuator (not illustrated) for the attachment as well as return of hydraulic power from the hydraulic actuator are conducted by the hydraulic power piping unit 40. The hydraulic power piping unit 40 includes a pair of laterally spaced vertical hose guides 8 and 9. The hose guide 8 is longer than the hose guide 9, and is formed with a vertically extending recess 8*a* for receiving therein flexible hydraulic hoses described later. The hose guide 9 is also formed with a vertically extending hose-receiving recess 9*a* and is laterally opposed to the recess 8*a* of the hose guide 8. The hose guide 8 is mounted off-center of the upright assembly 30 toward one of the outer stationary masts 1 and is fixedly attached to the upper cross beam 1*b* of the outer stationary masts 1 by a mounting plate 10 fixed to an upper portion of a backside flange of the hose guide 8 in such a manner that it is connected via a bracket 11 to the underface of the upper cross beam 1*b* by screw bolts 12. That is, the hose guide 8 is provided as a stationary member of the hydraulic power piping unit 30. Note, the vertical position of the hose guide 8 can be adjusted by the use of a vertically elongated hole 11*a* (FIG. 3) formed in the bracket 11.

On the other hand, the outer hose guide 9 is disposed on the back of the free lift cylinder 5 and is fixed to the middle tie beam 2*b* of the inner masts 2 by a mounting plate 13 fixed to an upper portion of a frontside flange of the hose guide 9 and connected to the back of the middle tie beam 2*b* by screw bolts 14, as shown in FIG. 2. The hose guide 9 is therefore able to move with the inner masts 2.

A pair of rigid hydraulic pipes 15 are disposed on and welded to the outer face of a web section of the hose guide 8, via two intervening plates 17 vertically spaced apart from one another.

Another pair of rigid hydraulic pipes 16 are similarly disposed on and welded to the outer face of a web section of the hose guide 9, via two intervening plates 18 vertically spaced apart from one another, as best shown in FIG. 3.

The pair of rigid hydraulic pipes 15 are cranked at their lower sections, extended laterally and away from the hose guide 8 until they have passed by the hose guide 9, when the rigid pipes 15 are again cranked downward. The rigid pipes 15 are eventually connected to flexible hydraulic hoses 19 extending from a control valve unit (not illustrated in FIGS. 1 through 3) mounted on a lift truck body, described later.

A pair of flexible hydraulic hoses 20 are received in the recesses 8*a* and 9*a* of the two hose guides 8 and 9 and hang down in a loose U-shape between both guides, as shown in FIGS. 1 and 3. The opposite ends of the two flexible hydraulic hoses 20 are connected to the tops of the above-mentioned rigid hydraulic pipes 15 and 16 by pipe joints 21 and 22. The sections of the flexible hydraulic hoses 20 received in the recesses 8*a* and 9*a* of the hose guides 8 and 9 vertically and freely extend downwardly within respective recesses 8*a* and 9*a* in such a manner that they are free to flex in response to relative vertical movement of the hose guide 9 against the stationary hose guide 8. The lower ends of the rigid hydraulic pipes 16 fixed to the outer face of the hose guide 9 are connected to a pair of flexible hydraulic hoses 23. At this stage, one of the rigid hydraulic pipes 16 is cranked so as to extend toward the lower end of the hose guide 8. Therefore, one of the flexible hydraulic hoses 23 is located on the left side of the free lift cylinder 5 while the other hose 23 is located on the right side of the free lift cylinder 5, as shown in FIG. 1. The two flexible hydraulic hoses 23 are disposed in such a manner that they extend upward toward a pair of hose pulleys 24 pivotally mounted on the same shaft as the chain wheels 7 of the free lift cylinder 5, pass around the hose pulleys 24, and finally reach the pipe joints 26 of the hydraulic actuator which are fixed to the lift bracket 4 by screw bolts. Each of the flexible hydraulic hoses 23 has, at a portion thereof, a short rigid pipe section 23*a* with a plate lug 23*b* which is fixed to the middle tie beam 2*b* by screw bolts 27. As a result, the flexible hydraulic hoses 23 are stably supported on the hose pulleys 24, respectively, and are prevented from slipping off the respective pulleys 24.

The hydraulic power piping unit 40, described above is compactly encased in the full free lift upright assembly 30, and is therefore prevented from being damaged.

When the pair of lift cylinders 3 are operated so as to lift the pair of inner masts 2 together with the free lift cylinder 5, the hose guide is also moved up against the stationary hose guide 8. Therefore, the hose guide 9 pulls up the flexible hydraulic hoses 20 held by the two hose guides 8 and 9. The flexible hydraulic hoses 20 are immediately able to move up with the hose guide 9 while freely flexing within the receiving recesses 8*a* and 9*a* of the two hose guides 8 and 9. When the hose guide 9 is lowered together with the inner masts 2 and the free lift cylinder 5, the flexible hydraulic hoses 20 are also able to immediately move down together with the hose guide 9. Thus, movement of the flexible hydraulic hoses 20 is always under the protection by the two hose guides 8 and 9.

With the flexible hydraulic hoses 23 supported on the hose pulleys 24, when either one of the lift cylinders 3 and the free lift cylinder 5 is operated or when both the lift cylinders 3 and the free lift cylinder 5 are operated, the assembly of flexible hydraulic hoses 23 moves together with the lift bracket member 4. Thus, the flexible hoses 23 are always maintained in a position such that they are hidden behind and protected by the lift bracket member 4.

Moreover, since the rigid hydraulic pipes 15 and 16 are welded to the outer face of the web portions of the hose guides 8 and 9, the rigidity of these pipes is always maintained during the operation of the full free lift upright assembly 30. In addition, the above-mentioned welding construction of the rigid hydraulic pipes 15 and 16 can be effective for simplifying the fabrication and assembly of both the full free lift upright assembly 30 and the hydraulic power piping unit 40, as well as reducing the manufacturing cost of a load handling lift truck.

Figure 4:
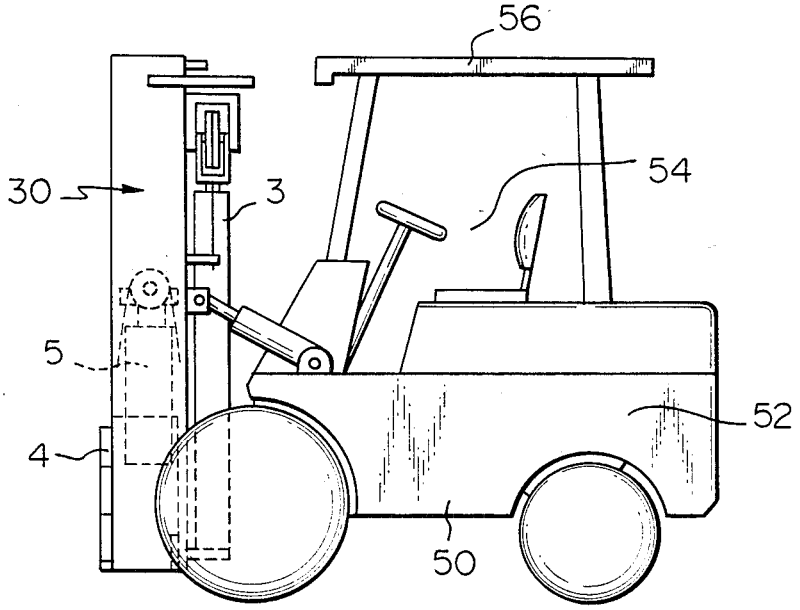
FIG. 4 is a side elevational view of a load handling lift truck in which the hydraulic power piping unit according to the present invention is accommodated.

FIG. 4 illustrates a typical load handling lift truck in which the hydraulic power piping unit 40 as described hereinbefore can be accommodated. The lift truck 50 has a wheeled truck body 52 in which a driver's seat 54 covered by an overhead guard 56 is mounted. In front of the truck body 52, the full free lift upright assembly 30 tiltable in both forward and back directions is assembled, having the lift cylinders 3, the free lift cylinder 5, and the lift bracket member 4. The hydraulic power piping unit 40 (not illustrated) is assembled and encased in the upright assembly. Thus, the tilting backward of the upright assembly toward the truck body 52 is not limited in any way.

From the foregoing description, it will be understood that in accordance with the present invention, a novel compact hydraulic power piping unit free from the likelihood of damage and capable of enhancing the function of the full free lift upright assembly is provided. However, it should be understood that various modifications of this invention may occur to those persons skilled in the art without departing from the spirit and scope of the present invention.

We claim:

1. In a lift truck having a truck body and a full free lift upright assembly, the assembly including a pair of laterally spaced outer stationary masts, a pair of laterally spaced inner masts movable vertically relative to the outer stationary masts, and a free lift cylinder attached to the inner masts for providing a free lift movement for a bracket member relative to the inner masts, a hydraulic power piping unit for a connection between a hydraulic control valve unit mounted in the truck body and a hydraulic actuator for an attachment to be mounted on the bracket member, comprising:

a pair of laterally spaced first and second vertical hose guide means for respectively receiving therein first and second sections of a first assembly of flexible hydraulic hoses arranged in such a manner that the first flexible hydraulic hose assembly hangs down in a loose U-shape between said first and second guide means, said first vertical hose guide means being fixedly attached to said outer stationary masts and said second vertical hose guide means being attached to one of said inner movable masts and said free lift cylinder for being moved therewith;

a first assembly of rigid hydraulic pipes held by said first vertical hose guide means and stationarily extended so as to connect said first section of the first assembly of flexible hydraulic hoses to a second assembly of flexible hydraulic hoses extending from said hydraulic control valve unit;

a second assembly of rigid hydraulic pipes held by said second movable vertical hose guide means and extended so as to connect said second section of the first assembly of flexible hydraulic hoses to a third assembly of flexible hydraulic hoses extending from said hydraulic actuator; and pulley means rotatably mounted on a vertical piston rod of said free lift cylinder, for supporting thereon said third assembly of flexible hydraulic hoses so as to permit said third assembly of flexible hydraulic hoses to follow said free lift movement of said bracket member.

2. The unit as set forth in claim 1, wherein said first and second vertical hose guide means are formed with a vertical recess for receiving therein said first assembly of flexible hydraulic hoses, respectively.

3. The unit as set forth in claim 2, wherein said first assembly of rigid hydraulic pipes is welded to said first vertical hose guide means and is connected to said first section of the first assembly of flexible hydraulic hoses by means of pipe joint means arranged on a top of said first vertical hose guide means, and wherein said second assembly of rigid hydraulic pipes is welded to said second vertical hose guide means and is connected to said second section of said first assembly of flexible hydraulic hoses by means of pipe joint means arranged on a top of said second vertical hose guide means.

4. The unit as set forth in claim 3, wherein said first section and second section of said first assembly of flexible hydraulic hoses are held in said vertical recesses of said first and second hose guide means in a free hanging position without any constraint.

5. The unit as set forth in claim 1, wherein said first vertical hose guide means is formed so as to be longer than said second vertical hose guide means.

6. The unit as set forth in claim 1, wherein said pulley means comprises a pair of hose pulleys pivotally and coaxially mounted on both sides of a top of said vertical piston rod of said free lift cylinder.

7. The unit as set forth in claim 6, wherein said second assembly of rigid hydraulic pipes comprises a first rigid hydraulic pipe cranked so as to extend toward one of said third assembly of flexible hydraulic hoses which is supported on one of said pair of hose pulleys, and a second rigid hydraulic pipe extended to the other of said third assembly of flexible hydraulic hoses which is supported on the other of said pair of hose pulleys.

* * * * *